US009709932B2

(12) United States Patent
Gilmore et al.

(10) Patent No.: US 9,709,932 B2
(45) **Date of Patent: *Jul. 18, 2017**

(54) FUSER ASSEMBLY AND METHOD FOR CONTROLLING FUSER OPERATIONS BASED UPON FUSER COMPONENT ATTRIBUTES

(71) Applicant: Lexmark International, Inc., Lexington, KY (US)

(72) Inventors: James Douglas Gilmore, Georgetown, KY (US); Russell Edward Lucas, Lexington, KY (US); Kevin Dean Schoedinger, Lexington, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/055,639

(22) Filed: Oct. 16, 2013

(65) Prior Publication Data

US 2014/0105618 A1 Apr. 17, 2014

Related U.S. Application Data

(60) Provisional application No. 61/715,258, filed on Oct. 17, 2012.

(51) Int. Cl.
*G03G 15/20* (2006.01)
*G03G 21/16* (2006.01)

(52) U.S. Cl.
CPC ..... *G03G 15/2039* (2013.01); *G03G 21/1652* (2013.01)

(58) Field of Classification Search
CPC ..... G03G 15/20
USPC ..... 399/12, 67–69, 33
See application file for complete search history.

(56) References Cited

U.S. PATENT DOCUMENTS

| | | | | |
|---|---|---|---|---|
| 5,023,464 | A * | 6/1991 | Mitsuya et al. | 399/323 |
| 6,253,053 | B1 * | 6/2001 | Litman et al. | 399/286 |
| 7,454,146 | B2 * | 11/2008 | Bischel et al. | 399/12 |
| 2006/0153605 | A1 * | 7/2006 | Nishiyama et al. | 399/329 |
| 2006/0239700 | A1 | 10/2006 | Schoedinger | |
| 2006/0263105 | A1 | 11/2006 | Able et al. | |
| 2008/0145086 | A1 | 6/2008 | Rasch | |
| 2008/0187328 | A1 * | 8/2008 | Schoedinger et al. | 399/21 |
| 2009/0080925 | A1 * | 3/2009 | Blair et al. | 399/69 |

(Continued)

OTHER PUBLICATIONS

International Search Report and Written Opinion of the International Searching Authority for PCT application PCT/US2013/065513, Mar. 20, 2014.

(Continued)

*Primary Examiner* — Clayton E Laballe
*Assistant Examiner* — Ruifeng Pu

(57) ABSTRACT

A fuser assembly for an electrophotographic imaging device, the fuser assembly including an integrated circuit chip having memory which has stored therein attribute data. The memory provides the attribute data for use in controlling the fuser assembly during fusing operations throughout the life of the fuser assembly. The attribute data includes a table of values corresponding to fusing temperatures for the fuser assembly, the fusing temperatures decreasing throughout the life of the fuser assembly to account for aging or wear of at least one component of the fuser assembly.

23 Claims, 6 Drawing Sheets

(56) References Cited

U.S. PATENT DOCUMENTS

| | | | | |
|---|---|---|---|---|
| 2009/0245838 | A1 | 10/2009 | Shuman et al. | |
| 2011/0020024 | A1 | 1/2011 | Berg et al. | |
| 2011/0194867 | A1 | 8/2011 | Mills, III | |
| 2012/0177387 | A1* | 7/2012 | Watanabe et al. | 399/26 |
| 2012/0301161 | A1* | 11/2012 | Fujimoto | 399/33 |
| 2013/0343770 | A1* | 12/2013 | Hewitt et al. | 399/12 |
| 2014/0212161 | A1* | 7/2014 | Cutts et al. | 399/70 |

OTHER PUBLICATIONS

International Preliminary Report on Patentability for PCT application PCT/US2013/065513, Apr. 21, 2015 and Written Opinion of the International Searching Authority, dated Mar. 20, 2014.

European Search Report, 13847325.1-1568/2909678, PCT/US2013065513, May 5, 2016.

* cited by examiner

FUSER ASSEMBLY AND METHOD FOR CONTROLLING FUSER OPERATIONS BASED UPON FUSER COMPONENT ATTRIBUTES

CROSS REFERENCES TO RELATED APPLICATIONS

The present application is related to and claims priority under 35 U.S.C. 119(e) from U.S. provisional application No. 61/715,258, filed Oct. 17, 2012, entitled, "Fuser Assembly and Method for Controlling Fuser Operations Based Upon Fuser Component Attributes," the content of which is hereby incorporated by reference herein in its entirety.

BACKGROUND

1. Field of the Disclosure

The present disclosure relates generally to controlling a fuser assembly of an electrophotographic imaging device, such as a laser printer or multifunction device having printing capability, and particularly to a fuser assembly including an integrated circuit chip or "smartchip" having fuser attribute data maintained therein for use in controlling the operation of the fuser assembly.

2. Description of Related Art

Belt fusers typically include an endless belt which rotates about a heater member which sufficiently heats the belt for use in a fusing operation to fuse toner onto a sheet of media. As the fuser belt coating wears and becomes thinner, more energy is transferred to the media sheet causing excessive curl and feed reliability issues.

With an imaging device having a reference edge paper feed architecture and demanding process speeds desired of the imaging device, a single heater width may be difficult to utilize to meet both edge-to-edge support and also maintain desired high throughput for both A4 & Letter sized media. With a single resistive trace length that supports edge-to-edge printing on Letter sized wide media, the non-reference side of the media sheet would tend to overheat when feeding A4 media (210 mm versus 215.9 mm) due to the non-reference side of the fuser nip not contacting the media sheet would not dissipate heat through the media sheet.

SUMMARY

To account for fuser belt coating thickness variation over life of the fuser assembly, a system and method were developed to adjust fusing temperatures at certain page/revolution counts over the life of the fuser. In an example embodiment, a table populated with data is maintained in memory on or otherwise coupled to an integrated circuit chip or smart chip coupled to the fuser assembly. The data in the table accounts for fuser belt coating thickness variation from the beginning of fuser usage throughout the life thereof. The table data is based on lot-to-lot sampling and characterized belt coating wear properties.

With the table populated, the engine or controller in the imaging device that is associated with the fuser assembly will access the table data and adjust the fusing temperature so that fusing operations are more consistent across the life of the fuser assembly. This table of data, together with other information indicating the age of the fuser assembly and/or the fuser belt thereof, is affixed to and stays with the fuser assembly such that if the fuser assembly is moved from one imaging device to another, the control of the fuser assembly does not change.

Accordingly, an example embodiment includes a fuser assembly for an imaging device, having an endless belt; a heater assembly including a holder and a heater member disposed within the endless belt for heating an inner surface thereof; a rotatable backup member coupled to the endless belt and heater assembly for forming a nip therewith; and an integrated circuit (IC) chip including memory having stored therein fuser attribute data for setting an operating condition of fuser operations performed by the fuser assembly. The fuser attribute data may provide a fuser temperature that varies based upon usage of the endless belt, with such usage being determined from, for example, a page count of sheets fused by the fuser assembly, a number of revolutions of a roll member in the fuser assembly, or the like. In an example embodiment, the fuser temperatures provided by the IC chip may decrease over the life of the fuser assembly, following an expected thinning of one or more fuser belt coatings thereof. By providing gradually lowering fuser temperatures by which the fuser assembly is to operate, the imaging device suitably compensates for the thinning of the fuser belt coating(s) such that fuser operations throughout the life of the fuser assembly (and/or fuser belt thereof) are more uniform and consistent. Further, the fuser assembly being heated to lower fusing temperatures throughout the life thereof advantageously results in less energy being used to heat the fuser assembly than energy usage levels associated with prior fuser assemblies.

Additional fuser attribute data stored in the IC chip may include an initial measurement of the fuser belt thickness, which may serve as an offset in selecting the fuser temperatures from the memory of the IC chip; and a type of detack mechanism utilized in or associated with the fuser assembly, which may be used to set the expected life of the belt fuser or to select the fuser temperature to be used by the fuser assembly. The fuser attribute data may further include fuser characteristics and/or dimensions for use in controlling the speed of the fuser assembly or other operating characteristics of the imaging device.

BRIEF DESCRIPTION OF THE DRAWINGS

The above-mentioned and other features and advantages of the disclosed embodiments, and the manner of attaining them, will become more apparent and will be better understood by reference to the following description of the disclosed embodiments in conjunction with the accompanying drawings, wherein.

DETAILED DESCRIPTION

Figure 1:
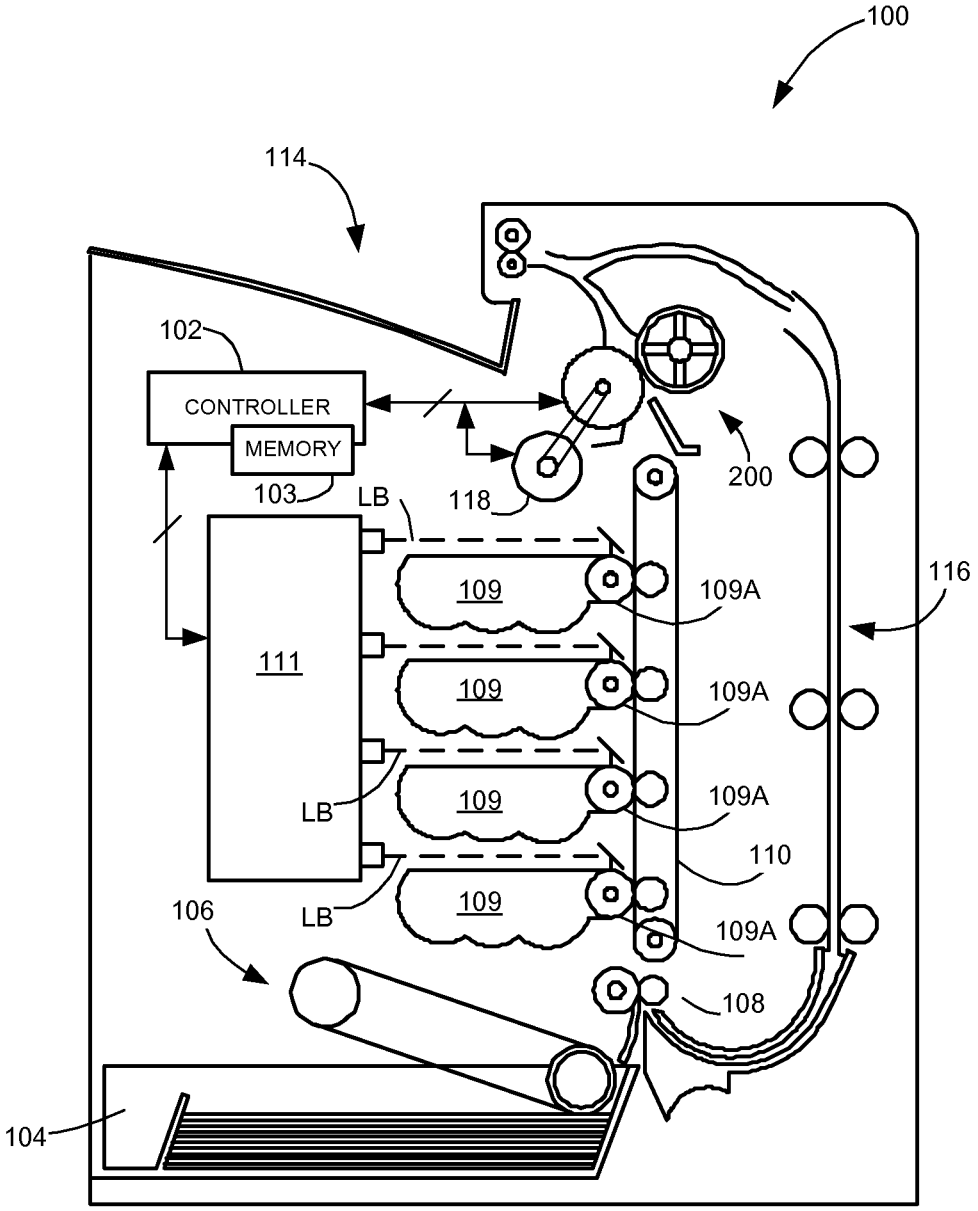
FIG. 1 is a side elevational view of an improved imaging device according to an example embodiment.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Terms such as "first", "second", and the like, are used to describe various elements, regions, sections, etc. and are not intended to be limiting. Further, the terms "a" and "an" herein do not denote a limitation of quantity, but rather denote the presence of at least one of the referenced item.

Furthermore, and as described in subsequent paragraphs, the specific configurations illustrated in the drawings are intended to exemplify embodiments of the disclosure and that other alternative configurations are possible.

Reference will now be made in detail to the example embodiments, as illustrated in the accompanying drawings. Whenever possible, the same reference numerals will be used throughout the drawings to refer to the same or like parts.

Referring now to the drawings and particularly to FIG. 1, there is shown an imaging device in the form of a color laser printer, which is indicated generally by the reference numeral 100. An image to be printed is typically electronically transmitted to a processor or controller 102 by an external device (not shown) or the image may be stored in a memory 103 embedded in or associated with the controller 102. Memory 103 may be any volatile and/or non-volatile memory such as, for example, random access memory (RAM), read only memory (ROM), flash memory and/or non-volatile RAM (NVRAM). Alternatively, memory 103 may be in the form of a separate electronic memory (e.g., RAM, ROM, and/or NVRAM), a hard drive, a CD or DVD drive, or any memory device convenient for use with controller 102. Controller 102 may include one or more processors and/or other logic necessary to control the functions involved in electrophotographic imaging.

In performing a print operation, controller 102 initiates an imaging operation in which a top media sheet of a stack of media is picked up from a media or storage tray 104 by a pick mechanism 106 and is delivered to a media transport apparatus including a pair of aligning rollers 108 and a media transport belt 110 in the illustrated embodiment. The media transport belt 110 carries the media sheet along a media path past four image forming stations 109 which apply toner to the media sheet through cooperation with laser scan unit 111. Each imaging forming station 109 provides toner forming a distinct color image plane to the media sheet. Laser scan unit 111 emits modulated light beams LB, each of which forms a latent image on a photoconductive surface or drum 109A of the corresponding image forming station 109 based upon the bitmap image data of the corresponding color plane. The operation of laser scan units and imaging forming stations is known in the art such that a detailed description of their operation will not be provided for reasons of expediency.

Fuser assembly 200 is disposed downstream of image forming stations 109 and receives from media transport belt 110 media sheets with the unfused toner images superposed thereon. In general terms, fuser assembly 200 applies heat and pressure to the media sheets in order to fuse toner thereto. After leaving fuser assembly 200, a media sheet is either deposited into output media area 114 or enters duplex media path 116 for transport to the most upstream image forming station 109 for imaging on a second surface of the media sheet.

Imaging device 100 is depicted in FIG. 1 as a color laser printer in which toner is transferred to a media sheet in a single transfer step. Alternatively, imaging device 100 may be a color laser printer in which toner is transferred to a media sheet in a two step process—from image forming stations 109 to an intermediate transfer member in a first step and from the intermediate transfer member to the media sheet in a second step. In another alternative embodiment, imaging device 100 may be a monochrome laser printer which utilizes only a single image forming station 109 for depositing black toner to media sheets. Further, imaging device 100 may be part of a multi-function product having, among other things, an image scanner for scanning printed sheets.

Figure 2:
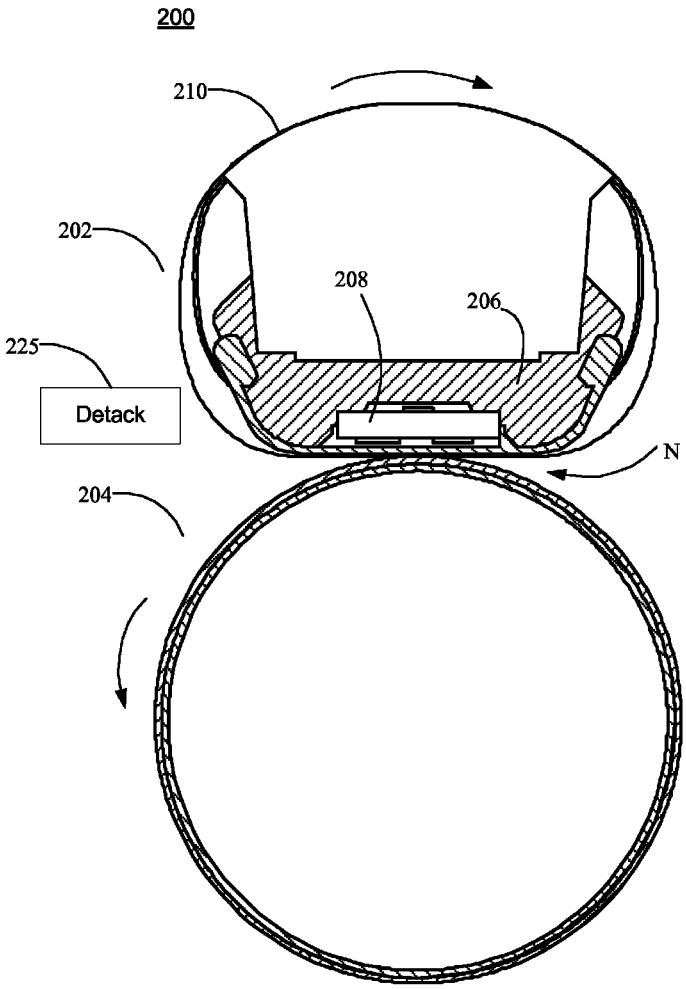
FIG. 2 is a cross sectional view of a fuser assembly of FIG. 1.

With respect to FIG. 2, fuser assembly 200 may include a heat transfer member 202 and a backup roll 204 cooperating with the heat transfer member 202 to define a fuser nip N for conveying media sheets therein. The heat transfer member 202 may include a housing 206, a heater member 208 supported on or at least partially in housing 206, and an endless flexible fuser belt 210 positioned about housing 206. Heater member 208 may be formed from a substrate of ceramic or like material to which one or more resistive traces is secured which generates heat when a current is passed through the resistive traces. Heater member 208 may further include at least one temperature sensor, such as a thermistor, coupled to the substrate for detecting a temperature of heater member 208. It is understood that heater member 208 alternatively may be implemented using other heat generating mechanisms.

Fuser belt 210 is disposed around housing 206 and heater member 208. Backup roll 204 contacts fuser belt 210 such that fuser belt 210 rotates about housing 206 and heater member 208 in response to backup roll 204 rotating. With fuser belt 210 rotating around housing 206 and heater member 208, the inner surface of fuser belt 210 contacts heater member 208 so as to heat fuser belt 210 to a temperature sufficient to perform a fusing operation to fuse toner to sheets of media.

Heat transfer member 202, fuser belt 210 and backup roll 204 may be constructed from the elements and in the manner as disclosed in U.S. Pat. No. 7,235,761, the content of which is incorporated by reference herein in its entirety. It is understood, though, that fuser assembly 200 may have a different architecture than a fuser belt based architecture. For example, fuser assembly 200 may be a hot roll fuser, including a heated roll and a backup roll engaged therewith to form a fuser nip through which media sheets traverse. The hot roll fuser may include an internal or external heater member for heating the heated roll. The hot roll fuser may further include a backup belt assembly. Hot roll fusers, with internal and external heating forming the heat transfer member with the hot roll, and with or without backup belt assemblies, are known in the art and will not be discussed further for reasons of expediency.

Figure 3:
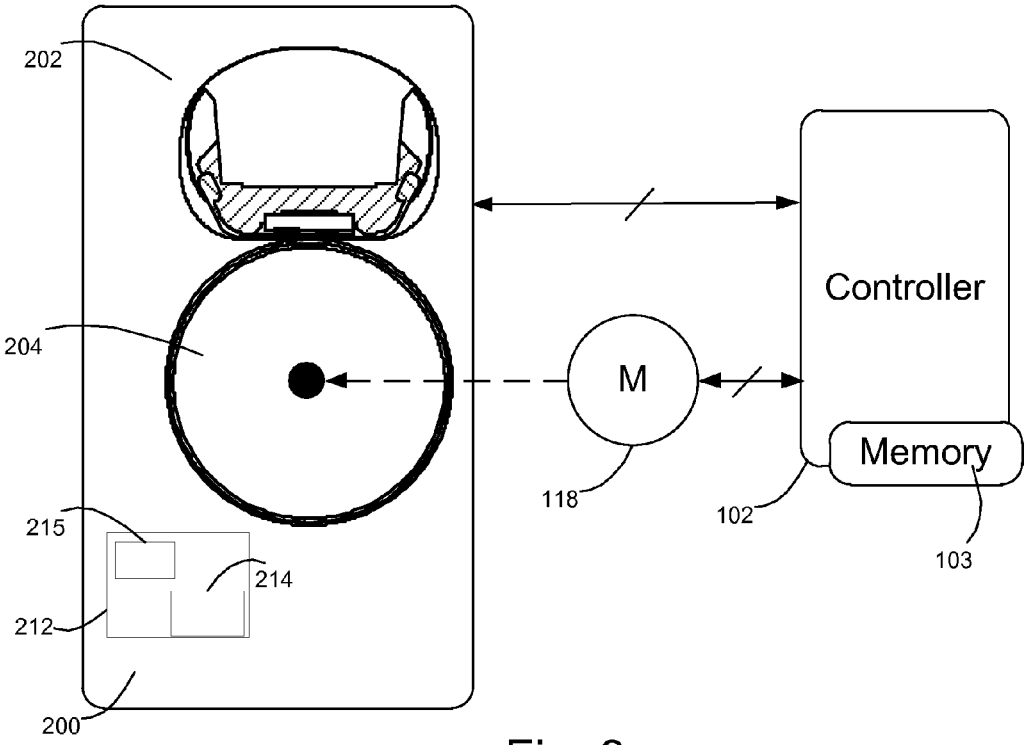
FIG. 3 is a block diagram illustrating electrical and mechanical coupling between components of the imaging device of FIG. 1.

Backup roll 204 may be driven by motor 118 (FIG. 1). Motor 118 may be any of a number of different types of motors. For instance, motor 118 may be a brushless D.C. motor or a stepper motor. Motor 118 may be coupled to backup roll 204 by any of a number of mechanical coupling mechanisms, including but not limited to a gear train (not shown). For simplicity, FIG. 3 represents the mechanical coupling between motor 118 and backup roll 204 as a dashed line. FIG. 3 also illustrates the communication between controller 102, motor 118 and fuser assembly 200. In particular, controller 102 generates control signals for controlling the movement of motor 118 and the temperature of heater member 208. Controller 102 may control motor 118 and heater member 208 during a fusing operation, for example, based in part upon feedback signals provided thereby. It is understood that additional circuitry may be disposed between controller 102, motor 118 and fuser assembly 200, including but not limited to driver circuitry for suitably conditioning control signals for driving motor 118 and heating heater member 208.

During a fusing operation, controller 102 controls heater member 208 to generate heat within a desired range of fusing temperatures. In addition, controller 102 controls motor 118 to cause backup roll 204 to rotate at a desired fusing speed during a fusing operation. The desired fusing speed and range of fusing temperatures are selected for achieving relatively high processing speeds and/or media throughput and effective toner fusing without appreciably affecting the useful life of, for example, fuser belt 210 and backup roll 204. Processing speeds and useful life are two performance based characteristics often associated with fuser assemblies.

In an example embodiment, fuser assembly 200 may include an IC chip 212 (FIG. 3). IC chip 212 may include nonvolatile memory 214 having stored therein attribute data for the fuser assembly 200. Fuser assembly 200 may include a housing (not shown) or one or more side panels to which IC chip 212 is affixed. Fuser assembly 200 may further include a connector for providing communication with controller 102. With fuser assembly 200 installed in imaging device 100, IC chip 212 may be communicatively coupled to controller 102. The attribute data may be uploaded into memory 103 and used by controller 102 in controlling one or more fusing operations by fuser assembly 200, or accessed from memory 214 as needed.

For instance, the attribute data maintained in IC chip 212 may include a table of data which when used tracks and compensates for the wear of fuser belt 210 over time. Specifically, one or more coatings on fuser belts, such as a fuser belt release coating, has been found to become thinner throughout the useful life of the fuser belt. As a fuser belt coating thins, a lower fuser temperature is needed with which to heat heater member 208 in order to sufficiently heat fuser nip N for fusing toner to media sheets. The attribute data in the table, obtained through characterization of fuser belt 210 over its lifetime, effectively maps fuser temperature to the age of fuser belt 210. In an example embodiment, the age of fuser belt 210 and/or fuser assembly 200 may be determined by the page count of pages fused by fuser assembly 200 and/or the number of revolutions of backup roll 204. The current age of fuser belt 210 and/or fuser assembly 200 may be maintained in memory 214 of IC chip 212, outside of memory 214 but within IC chip 212, or memory 103 associated with controller 102. The age of fuser belt 210 and/or fuser assembly 200 may form at least part of the input to the data table of memory 214 for receiving therefrom the fuser temperature corresponding to the current age of fuser belt 210. The received fuser temperature, corresponding to the current fuser belt age, may then be used by controller 102 in subsequent fusing operations.

In an alternative example embodiment, the attribute data maintained in memory 214 may be a formula for determining the fuser temperature for fuser assembly 200 during subsequent fusing operations. In this embodiment, the current age and/or usage of fuser belt 210 may be an input to the formula for generating a corresponding fuser temperature. In either example embodiment, IC chip 212 maps the current age or usage of fuser belt 210 to a fuser temperature value for use in subsequent fusing operations.

The current age of fuser belt 210 and/or fuser assembly 200 may be maintained by a counter 215 or the like controlled by and/or in communication with controller 102 or circuitry within IC chip 212. In an example embodiment, counter 215 is in IC chip 212 and in another embodiment may be a part of memory 214. When, for example, a predetermined number of pages are subsequently fused following initial use of a new fuser temperature, and/or a predetermined number of revolutions of backup roll 204 have subsequently occurred, controller 102 and/or IC chip 212 may use the current age, essentially amounting to the total number of pages fused or backup roll revolutions by fuser assembly 200, to obtain a new fuser temperature value from the data table (or formula) in memory 214 corresponding to the current age for use in fusing operations going forward. By varying the fuser temperature of fuser assembly 200 to account for the wear (i.e., thinning of one or more fuser belt coatings) of fuser belt 210, more consistent fuser operations are achieved over the life of fuser belt 210 and/or fuser assembly 200.

As with most manufactured items, dimensions of belt fuser 210 may vary when manufactured. One such dimension which varies is thickness. Example embodiments address the initial variance in belt thickness by maintaining in memory 214 of IC chip 212 a value corresponding to an initial thickness of fuser belt 210 as additional fuser attribute data. The value may be stored in memory 214 at the time of manufacture of fuser assembly 200 and/or at the time the thickness of fuser belt 210 is measured. The value may be used as an offset in selecting from memory 214 the initial fuser temperature by which fuser assembly 200 initially operates. In this way, the thickness of fuser belt 210 may be initially tracked more accurately and thus may be more accurately tracked over the life thereof so ensure more consistent and uniform fusing operations.

Fuser assemblies having both belt fuser and hot roll architectures are known to include detack mechanisms for separating fused media sheets from the fuser assemblies for subsequent transport of the fused media sheets to an output tray or bin of the image device. In an example embodiment, fuser assembly 200 includes a detack mechanism 225 associated with at least one of backup roll 204 and fuser belt 210, and the attribute data maintained in memory 214 of IC chip 212 may indicate the type of detack mechanism 225 used in fuser assembly 200 to separate, for example, a media sheet from backup roll 204 and/or fuser belt 210. Based upon the type of detack mechanism 225 used in fuser assembly 200, controller 102 may set the life of fuser assembly 200 over which imaging device 100 (or any other imaging device containing fuser assembly 200) may use fuser assembly 200. The life of fuser assembly 200 may be based upon a total page count and/or a total number of revolutions of backup roll 204. Detack mechanisms are well known in the art such that a description of detach mechanism 225 will not be provided for reasons of simplicity.

The operation of fuser assembly 200 will be described with respect to FIG. 5. The operation of fuser assembly, as well as imaging device 100, begins at 502. This may, for example, correspond to the first time imaging device 100 is used. Data corresponding to the measured thickness of fuser belt 210 and/or the type of detack mechanism used in fuser assembly 200 may be read from memory at 504. The memory may be memory 214 of IC chip 212 according to an example embodiment so as to ensure that this fuser-specific data remains with fuser assembly 200 even when moved from imaging device to imaging device. It is understood, though, that such data may be maintained in memory 103. Next, a value corresponding to the temperature of heater member 208 is determined at 506. This determination may be based upon the data corresponding to the initial belt thickness and the type of detack mechanism read from memory at 504, as described above. This determination may also be based upon age/wear data stored in memory 214 if fuser assembly 200 had been previously used to perform fusing operations. The determination at 506 may be performed by reading memory 214 using an address value formed from the initial belt thickness, the type of detack mechanism and any prior age/wear data. The output of memory 214 is the appropriate fusing temperature or a value from which the appropriate fusing temperature may be derived. The value may then be sent to controller 102 for setting the temperature of heater member 208 in subsequent fusing operations at 508.

During the operation of imaging device 100, a point is reached at 510 when the age (and/or wear level) of fuser belt 210 requires updating. This point in time may be based upon fuser assembly 200 (or belt fuser 210) fusing a predetermined number of sheets, backup roll 204 reaching a predetermined number of revolutions, or the like. As mentioned, a counter 215 in IC chip 212 may increment or decrement with each page fused or each roll revolution, and when the counter value reaches the predetermined number, IC chip 212 or controller 102 may use at 512 attribute data in memory 214 and the counter 215 having reached the predetermined number to determine a value corresponding to a new fuser temperature at 514. In one example embodiment, the determination at 514 may be performed by accessing the above-described table in memory 214 using an input address that is based upon the current age/wear of belt fuser 210. Specifically, the counter 215 reaching the predetermined number may cause another counter (not shown) to increment, for example, the output of which is all or part of the input address for reading a value from the table corresponding to a new fuser temperature. After a value corresponding to a new fuser temperature value is read from memory 214, the value may be used by controller 102 in subsequent fusing operations at 516 to control the temperature of heater member 208. Alternatively, the above-mentioned attribute data formula may be read from memory 214 and a value corresponding to a new fuser temperature determined using the formula and the current age/wear of belt fuser 210. At around the time the value corresponding to the new fuser temperature is determined at 514, the counter 215 maintaining a page count and/or backup roll revolution count may be reset for counting a new page count/revolution count, and the process returns to 510 to await the next time the fuser temperature is to be adjusted to account for further thinning of one or more coatings of belt fuser 210.

Figure 5:
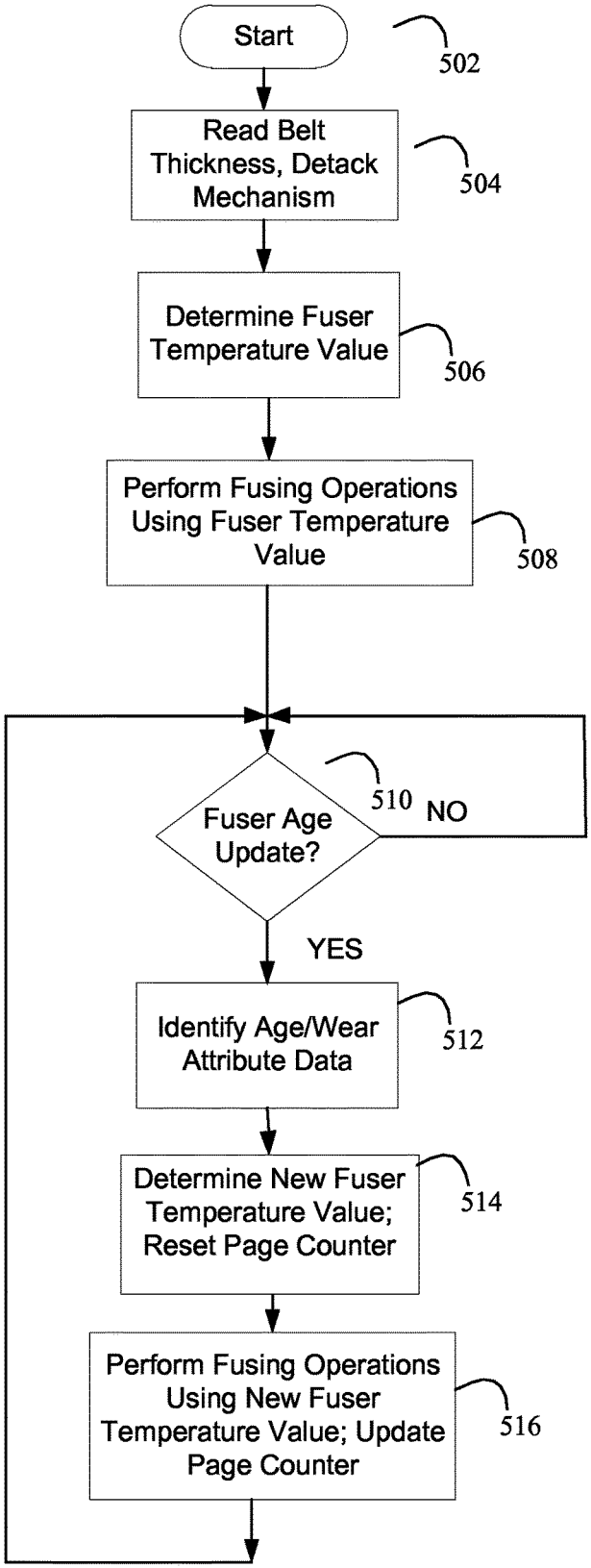
FIG. 5 is a flow chart illustrating an operation of the fuser assembly according to an example embodiment.

FIG. 5 illustrates a method of generating values corresponding to fuser temperatures from the first use of a fuser assembly 200. In the case in which fuser assembly 200 has been previously used in a different imaging device (so as to have age/wear data stored in memory 214) and is being used for the first time in imaging device 100, operation may begin at act 512 of FIG. 5.

In an example embodiment, memory 214 may maintain additional attribute data relating to fuser assembly 200 for use in controlling fuser assembly 200 and/or other modules or subsystems of imaging device 100. The additional attribute data maintained in memory 214 of IC chip 212 may include data indicating the type of heater member 208 used in fuser assembly 200. In particular, the different heater member types may include, for example:

1) standard 220v, A4 width heater member for highest throughput & edge-to-edge fusing of A4 sized media;

2) standard 110v, Letter width heater member for highest throughput & edge-to-edge for letter sized media;

3) a customized 220v, Letter heater member;

4) a customized 110v, A4 heater member; and 5) a customized heater member having dual branches for effectively handling both A4 and Letter sized media, targeted for predetermined geographies.

As can be seen, this attribute data of heater member 208 that is stored in memory includes the length of the heat-generating resistive trace(s) of heater member 208. Data corresponding to the length of the resistive trace, or other heating element of heater member 208 which generates the heat necessary for a fusing operation, may be used by controller 102 to control the operation of fuser assembly 200. IC chip 212 may include an interface for communicating to controller 102 the attribute data during each power on or warm-up cycle of imaging device 100. In an example embodiment, attribute data corresponding to the type and/or length of heater member 208 may be passed to controller 102. Based on these attributes, controller 102 provides the control and safeguards described below.

Figure 6:
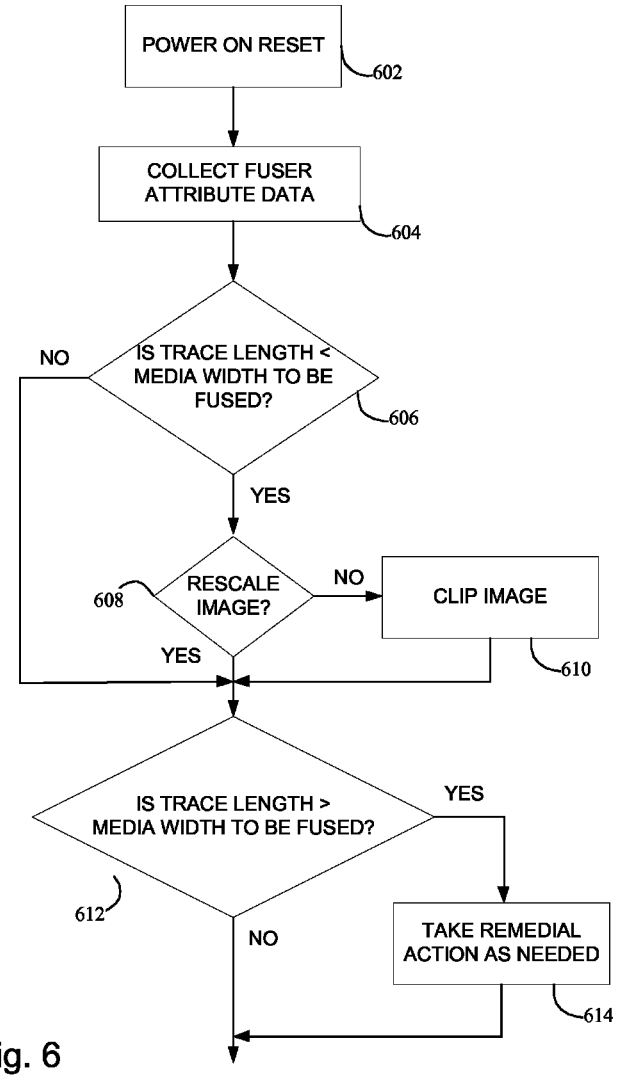
FIG. 6 is a flow chart illustrating an operation of the fuser assembly according to an example embodiment.

The method of operating fuser assembly 200 using the above-mentioned additional attribute data will be described with reference to FIG. 6. After a regular event, such as a POR operation at 602, fuser attribute data is collected at 604. The attribute data, which may be the type of heater member 208 appearing in fuser assembly 200, the length of the resistive traces of heater member 208 or a combination thereof, may be collected by reading the attribute data from memory 214. The collected attribute data may be used by controller 102 to control the operation of fuser assembly 200. For example, if the length of the resistive trace is collected at 604, controller 102 may determine at 606 whether in an upcoming fusing operation the resistive trace length is less than the width of the media sheet to be fused. If so, then the size of the image on the media sheet is changed so as to ensure that toner forming the entire image is suitably fused by heater member 208. This can entail, for example, the image being rescaled and/or compressed at 608 or clipped and/or cropped at 610. If the length of the resistive trace is not less than the width of the media sheet to be fused, image rescaling and clipping is not needed.

Further, if the collected length of the resistive trace of heater member 208 is greater than the width of the sheet of media to be fused, indicating fusing narrow media, controller 102 may take action at 614 to ensure that heater member 208 and/or backup roll 204 do not overheat from fusing narrow media. For instance, if the number of sheets of narrow media to be fused is a relatively large number, controller 102 may slow the fusing process by, among other things, increasing the interpage gap between media sheets. As a result of slowing the fusing process for narrow sheets, overheating may be avoided.

Figure 4:
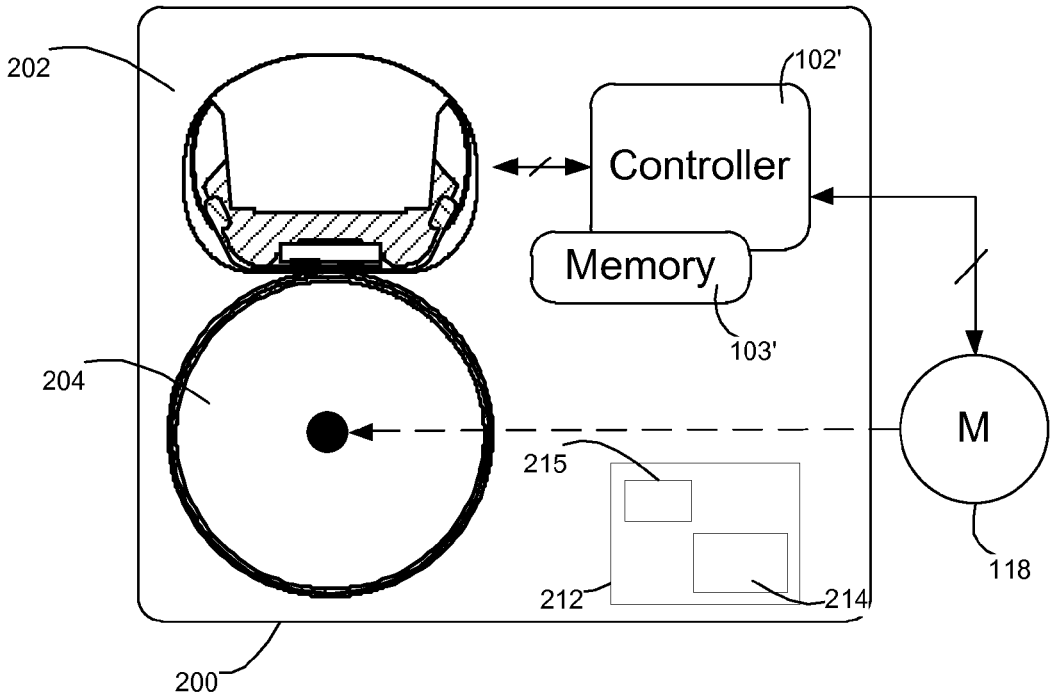
FIG. 4 is a block diagram illustrating electrical and mechanical coupling between components of the imaging device of FIG. 1 according to an alternative embodiment.

As mentioned, controller 102 may be implemented using one or more processors. FIG. 4 depicts a multi-processor implementation in which an additional processor or controller 102' and memory 103' coupled thereto are mounted and/or physically connected to fuser assembly 200, in accordance with another example embodiment. Controller 102' may generally control the operation of motor 118, including determining and controlling the fusing temperature of fuser assembly 200, and controller 102 (FIG. 1) may control the operation of components and assemblies within imaging device 100 other than fuser assembly 200.

The foregoing description of several methods and an embodiment of the invention have been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

The invention claimed is:

1. A fuser assembly for an imaging device, comprising:

an endless belt;

a heater assembly including a holder and a heater member disposed within the endless belt for heating an inner surface thereof;

a rotatable backup member coupled to the endless belt and heater assembly for forming a nip therewith; and an integrated circuit chip including memory having stored therein fuser attribute data for setting at least one operating condition of fuser operations performed by the fuser assembly, wherein the memory provides the fuser attribute data as values corresponding to fusing temperatures for the fuser operations that vary based upon usage of the endless belt and wherein the fuser assembly includes a detack mechanism, and the fuser attribute data comprises a type of the detack mechanism and a value corresponding to a measured initial characteristic of a component of the fuser assembly, the component being one of the endless belt, the heater member and the rotatable backup member, and the value corresponding to the measured initial characteristic of the component forming an offset for providing the values corresponding to the varying fusing temperature.

2. The fuser assembly of claim 1, wherein throughout a life of the endless belt, the memory provides the fuser attribute data as values corresponding to a plurality of fusing temperatures for the fuser operations to be performed by the fuser assembly.

3. The fuser assembly of claim 1, wherein the values corresponding to the fuser temperatures are such that the fusing temperatures decrease over the life of the endless belt.

4. The fuser assembly of claim 1, wherein the fuser attribute data comprises a dimension of at least one component of the heater member for use in determining whether to modify an image to be printed by the imaging device.

5. The fuser assembly of claim 1, wherein the fuser attribute data indicates a dimension of at least one component of the heater member for determining whether to decrease processing speed of the fuser assembly.

6. The fuser assembly of claim 1, wherein the heater member includes a resistive trace member which generates heat when activated, and the fuser attribute data stored in the memory identifies a length of the resistive trace member.

7. The fuser assembly of claim 1, wherein the IC chip includes a count value corresponding to a number of sheets of media fused or a number of revolutions of the rotatable backup member, and wherein when the count value reaches a predetermined number, the memory provides a value corresponding to a new fusing temperature for the heater member during subsequent fuser operations.

8. The fuser assembly of claim 1, wherein the measured initial characteristic comprises a measured initial thickness of the endless belt, the value corresponding to the measured initial thickness of the endless belt forming an offset for providing the values corresponding to the varying fusing temperature.

9. The fuser assembly of claim 1, wherein the measured initial characteristic comprises a measured initial dimension of a component of the fuser assembly, and the value corresponding to the measured initial dimension of the component forming the offset for providing the values corresponding to the varying fusing temperature.

10. The fuser assembly of claim 9, wherein the component comprises the endless belt and the measured initial dimension comprises a measured initial thickness of the endless belt.

11. The fuser assembly of claim 9, wherein the component comprises the endless belt and the measured initial dimension comprises a measured initial thickness of the endless belt.

12. The fuser assembly of claim 1, wherein the fuser attribute data is used to control the fuser assembly during fusing operations throughout a life of the fuser assembly.

13. A fuser assembly for an imaging device, comprising:

a heat transfer member for generating heat;

a rotatable backup member coupled to the heat transfer member; and an integrated circuit (IC) chip including memory having stored therein fuser attribute data for controlling the fuser assembly during fusing operations throughout a life of the fuser assembly, wherein the heat transfer member comprises a heater element for generating heat for the fusing operations, and the fuser attribute data maintained in the memory includes data corresponding to a length of the heater element.

14. The fuser assembly of claim 13, wherein the memory maintains the fuser attribute data for varying a fusing temperature of the heater element throughout a life of the endless belt.

15. The fuser assembly of claim 14, wherein the fuser attribute data is provided by the memory as values corresponding to the varying fusing temperature for the heater element during the fusing operations, the fusing temperatures decreasing throughout the life of the endless belt.

16. The fuser assembly of claim 15, wherein an input address to the memory for providing the values corresponding to the varying fusing temperature is based upon an age or wear of the endless belt.

17. The fuser assembly of claim 16, wherein the IC chip maintains a value corresponding a total number of sheets of media fused or a number of revolutions of the rotatable backup member by the fuser assembly, such that when the value reaches a predetermined value, the input address to the memory is changed so the memory outputs a value corresponding to a different fusing temperature that is lower than prior fusing temperatures used by the fuser assembly.

18. The fuser assembly of claim 13, further comprising a detack mechanism for separating media sheets from the fuser assembly, wherein the fuser attribute data stored in the memory includes a type of the detack mechanism.

19. The fuser assembly of claim 13, wherein the fuser attribute data comprises a table of fuser temperatures, an input address to the table being based upon prior usage of at least one component of the fuser assembly.

20. The fuser assembly of claim 13, wherein the measured initial dimension of the endless belt comprises a thickness of the endless belt.

21. A fuser assembly for an imaging device, comprising:

a heat transfer member, comprising a heater element for generating heat;

a rotatable backup member coupled to the heat transfer member;

a detack mechanism; and an integrated circuit chip including memory having stored therein fuser attribute data for setting at least one fuser temperature of the heater element during fuser operations performed by the fuser assembly, wherein the heat transfer member comprises the heater element and an endless belt in which the heater element is disposed for heating an inner surface of the endless belt, the fuser attribute data comprises a value corresponding to a measured initial thickness of the endless belt, wherein throughout the life of the endless belt, the memory provides the fuser attribute data as values corresponding to a plurality of fusing temperatures for the fuser operations to be performed by the fuser assembly, and the value corresponding to the initial thickness of the endless belt forming an offset for selecting at least one of the values corresponding to the plurality of fusing temperatures.

22. The fuser assembly of claim 21, wherein the fuser attribute data sets a plurality of fuser temperatures for the heater element throughout a life of the endless belt based upon prior usage thereof.

23. An imaging device, comprising:

a fuser assembly having a heat transfer member for generating heat;

a rotatable backup member coupled to the heat transfer member; and an integrated circuit chip including memory having stored therein fuser attribute data for controlling the fuser assembly during fusing operations throughout a life of the fuser assembly; and a detack mechanism for separating media sheets from the fuser assembly, wherein the fuser attribute data stored in the memory includes a type of the detack mechanism.

* * * * *